US010206508B2

(12) United States Patent
Desanta et al.

(10) Patent No.: US 10,206,508 B2
(45) Date of Patent: Feb. 19, 2019

(54) CHAIR, IN PARTICULAR OFFICE CHAIR

(71) Applicant: Haworth, Inc., Holland, MI (US)

(72) Inventors: Simon Desanta, Borgholzhausen (DE); Wilhelm Schulz, Pr. Oldendorf (DE)

(73) Assignee: Haworth, Inc., Holland, MI (US)

( * ) Notice: Subject to any disclaimer, the term of this patent is extended or adjusted under 35 U.S.C. 154(b) by 2 days.

(21) Appl. No.: 15/518,964

(22) PCT Filed: Oct. 13, 2015

(86) PCT No.: PCT/EP2015/073638
§ 371 (c)(1),
(2) Date: Apr. 13, 2017

(87) PCT Pub. No.: WO2016/059031
PCT Pub. Date: Apr. 21, 2016

(65) Prior Publication Data

US 2017/0231391 A1 Aug. 17, 2017
US 2018/0035804 A9 Feb. 8, 2018

(30) Foreign Application Priority Data

Oct. 13, 2014 (DE) ..... 10 2014 220 695

(51) Int. Cl.
*A47C 3/00* (2006.01)
*A47C 1/032* (2006.01)
*A47C 7/44* (2006.01)

(52) U.S. Cl.
CPC ..... *A47C 1/03294* (2013.01); *A47C 7/445* (2013.01)

(58) Field of Classification Search
CPC ... A47C 1/03255; A47C 7/46; A47C 1/03272; A47C 1/03266; A47C 7/40;
(Continued)

(56) References Cited

U.S. PATENT DOCUMENTS 4,084,850 A * 4/1978 Ambasz ..... A47C 3/025 297/317
4,830,430 A * 5/1989 Schafer ..... A47C 7/445 297/296
(Continued)

FOREIGN PATENT DOCUMENTS

DE 102006030018 1/2008
DE 102011051966 1/2013
(Continued)

OTHER PUBLICATIONS

International Search Report of International Application PCT/EP2015/073638, dated Nov. 20, 2015.

*Primary Examiner* — Shin H Kim
(74) *Attorney, Agent, or Firm* — Warner Norcross + Judd LLP

(57) ABSTRACT

The invention relates to a chair, in particular a conference or visitor chair, which allows a coupled movement of a seat (3) and a backrest. The seat in this case is mounted in sliding bearings (4) comprising oblique guide surfaces (6) and is displaced and raised in the sliding bearings through a mounting end (5) of the backrest. According to the invention, two separate backrest bars (11) are provided, which are connected to the mounting ends (5), wherein the backrest bars can be moved independently of each other. In this way, different seat positions can be realized. Besides an upright standard position, an inclined high position, and an asymmetrical position, in which a one-sided load of a backrest bar (11) can be realized with a corresponding displacement and rotation of the seat (3).

8 Claims, 3 Drawing Sheets

Figure 7:
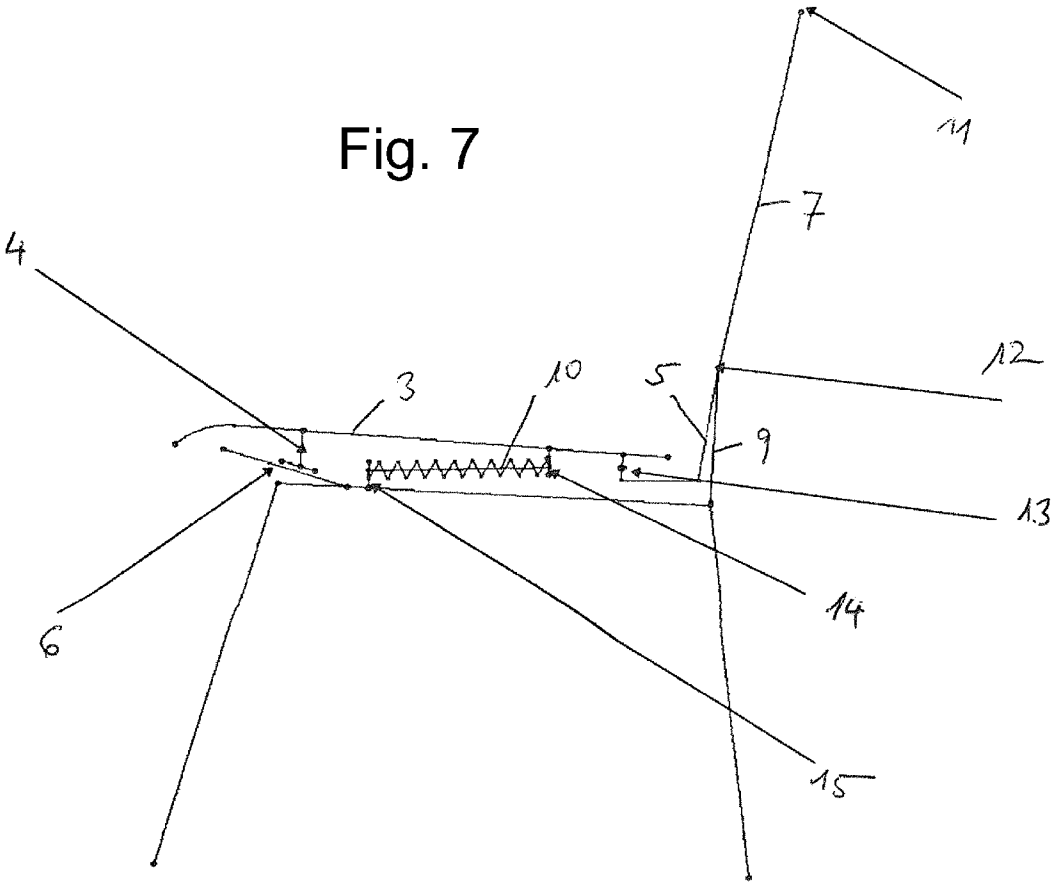

(58) Field of Classification Search
CPC ..... A47C 31/023; A47C 7/14; A47C 7/462; A47C 7/24; A47C 7/44
See application file for complete search history.

(56) References Cited

U.S. PATENT DOCUMENTS

| | | | | | |
|---|---|---|---|---|---|
| 5,249,839 | A * | 10/1993 | Faiks | A47C 1/03255 | 297/284.4 |
| 5,951,109 | A * | 9/1999 | Roslund, Jr. | A47C 1/03255 | 297/299 |
| 5,988,746 | A * | 11/1999 | Raftery | A47C 7/445 | 297/297 |
| 6,056,361 | A * | 5/2000 | Cvek | A47C 3/021 | 297/173 |
| 6,086,153 | A * | 7/2000 | Heidmann | A47C 1/023 | 297/300.1 |
| 6,189,971 | B1 * | 2/2001 | Witzig | A47C 1/023 | 297/284.1 |
| 6,257,665 | B1 * | 7/2001 | Nagamitsu | A47C 7/405 | 297/285 |
| 6,406,096 | B1 * | 6/2002 | Barile, Sr. | A47C 7/445 | 297/296 |
| 6,913,316 | B2 * | 7/2005 | Kinoshita | A47C 7/405 | 297/300.1 |
| 7,273,253 | B2 * | 9/2007 | Deimen | A47C 1/03222 | 297/300.2 |
| 7,717,513 | B2 * | 5/2010 | Ueda | A47C 7/443 | 297/300.2 |
| 9,504,330 | B2 * | 11/2016 | Gehner | A47C 7/14 | |
| 9,962,304 | B2 * | 5/2018 | Peek | A61G 5/1056 | |
| 2002/0180248 | A1 * | 12/2002 | Kinoshita | A47C 1/023 | 297/284.1 |
| 2002/0180252 | A1 * | 12/2002 | Kinoshita | A47C 1/03238 | 297/463.1 |
| 2003/0127896 | A1 * | 7/2003 | Deimen | A47C 7/14 | 297/301.1 |
| 2004/0066075 | A1 * | 4/2004 | Yeh | A47C 4/286 | 297/354.1 |
| 2004/0140701 | A1 * | 7/2004 | Schmitz | A47C 7/44 | 297/284.4 |
| 2004/0183350 | A1 * | 9/2004 | Schmitz | A47C 1/03255 | 297/301.1 |
| 2007/0108819 | A1 * | 5/2007 | Ueda | A47C 7/443 | 297/292 |
| 2007/0108820 | A1 * | 5/2007 | Ueda | F16F 1/22 | 297/300.5 |
| 2007/0108821 | A1 * | 5/2007 | Ueda | A47C 1/03255 | 297/301.1 |
| 2007/0108822 | A1 * | 5/2007 | Ueda | A47C 1/03255 | 297/301.6 |
| 2007/0108831 | A1 * | 5/2007 | Ueda | A47C 1/03255 | 297/452.29 |

FOREIGN PATENT DOCUMENTS

| | | |
|---|---|---|
| EP | 1785067 | 5/2007 |
| WO | 9220262 | 11/1992 |
| WO | 2014029696 | 2/2014 |

* cited by examiner

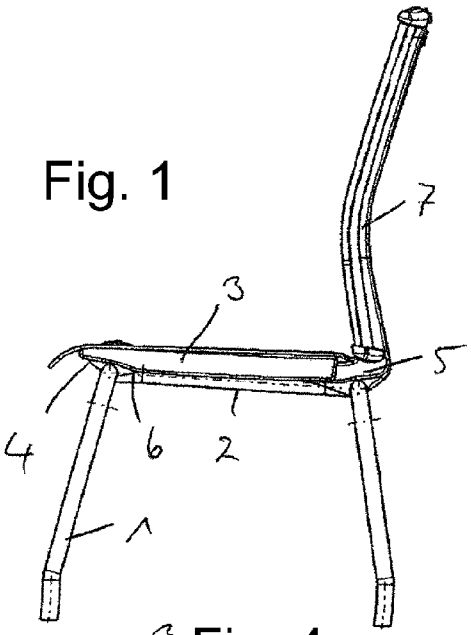
Fig. 1
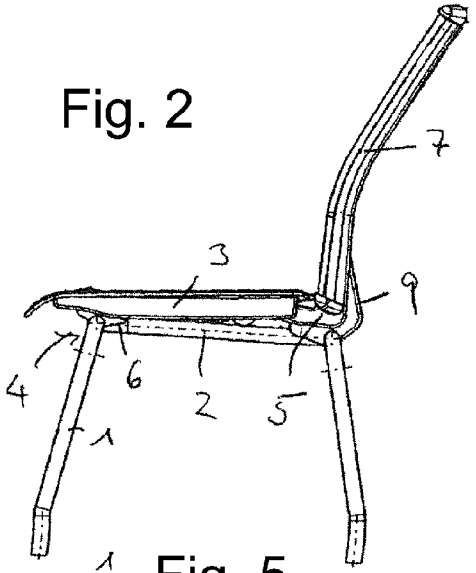
Fig. 2
Fig. 3
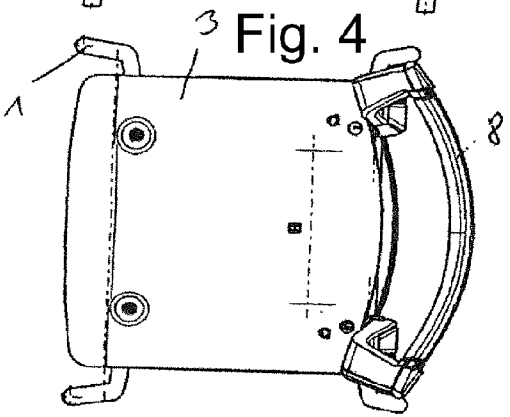
Fig. 4
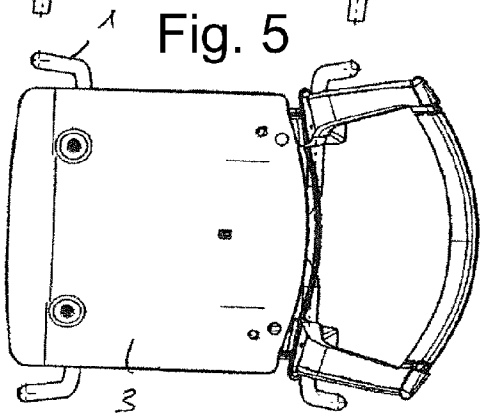
Fig. 5
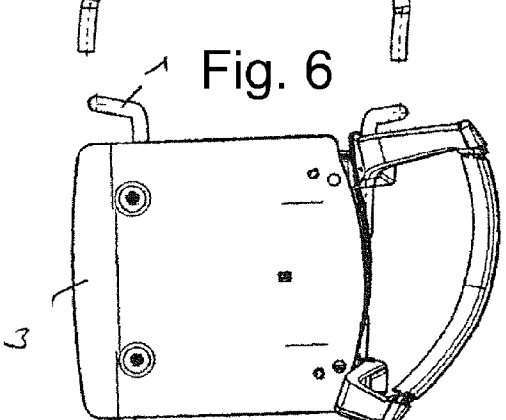
Fig. 6

CHAIR, IN PARTICULAR OFFICE CHAIR

The invention relates to a chair, in particular an office chair with a movable seat and a movable backrest, wherein a backrest movement is coupled with a seat movement.

As office swivel chairs, such chairs are mostly provided with complex synchronous mechanisms for the movement coupling. An example in this respect is shown by WO 2014/029696 A1. In this known chair, the possibility furthermore exists of the chair being able to adapt to different loads on the two sides of the chair and of further increasing the sitting comfort in this way by mounting the seat in a laterally tiltable manner.

A chair with a swivable and pivotable seat surface is known from EP 2 508 102 B1.

Complex seat mechanisms are generally only suitable for high-quality office swivel chairs or armchairs. In this respect, there is an increasing need to also improve the sitting comfort in simpler chairs, such as so-called conference chairs or visitor chairs.

Accordingly, the invention is based on the task of specifying a chair with a simplified seat mechanism, which can be realized in a cost-effective manner and which further improves the sitting comfort.

This task is solved by a chair according to claim 1; the dependent claims relate to advantageous embodiments of the invention.

According to the invention, the chair comprises a base frame with a seat and a backrest, which comprises two side supports that are articulated on the seat and on the base frame swivably independently of each other, wherein the seat is mounted displacably on the base frame. By means of the coupling of the side supports with the seat, a pivoting of the backrest displaces the seat so that the user can assume a reclined resting position.

Since the side supports can be swiveled independently of each other, the chair can adapt to different lateral loads acting on the backrest.

Preferably, each of the side supports comprises an angled mounting end, in particular in L-shape, the one arm of which is connected to the rear end of the seat by means of a ball joint and the other arm of which comprises a backrest bar. By means of the selection of the dimensioning of the arms or the mounting points, a desired magnitude of the displacement of the seat can be realized. In this design, a pivoting of the backrest can at the same time furthermore be converted into a stroke movement of the seat in addition to a displacement.

In this respect, the seat movement can in particular be supported by the front edge of the seat being mounted in at least one sliding bearing.

Preferably, the sliding bearing comprises oblique guide surfaces and a free space defined at both sides. In this way, a design engineer is given another degree of freedom for adjusting the so-called synchronous ratio or the seat position and on the other hand, the restoring force of the backrest is transferred proportionally to the body weight of the user.

In combination with the stroke movement as a result of the pivoting of the backrest and the displacement in the oblique guide surfaces, different seat positions can thus be realized, such as a parallel displacement of the seat by the stroke as a result of the backrest interconnection and the stroke as a result of the displacement in the oblique guide surfaces being equal, or an inclination and rotation of the seat corresponding to the lateral free space of the sliding bearing if the strokes are different.

Preferably, spring elements are provided, which are mounted on the one hand on the seat and on the other hand on the base frame and thus pre-load the chair in its standard position and provide a base resistance of the backrest to the user during reclining.

Preferably, the side supports are connected to each other via at least one rod articulated elastically on the side supports, for example, and/or designed to be elastic itself.

The sliding bearings are preferably designed such that they allow for a rotation of the seat in its seating plane. In this way, a pivoting of only one side support can follow in case of a one-sided load on the backrest the seat, whereby the sitting comfort is further increased.

Figure 9:
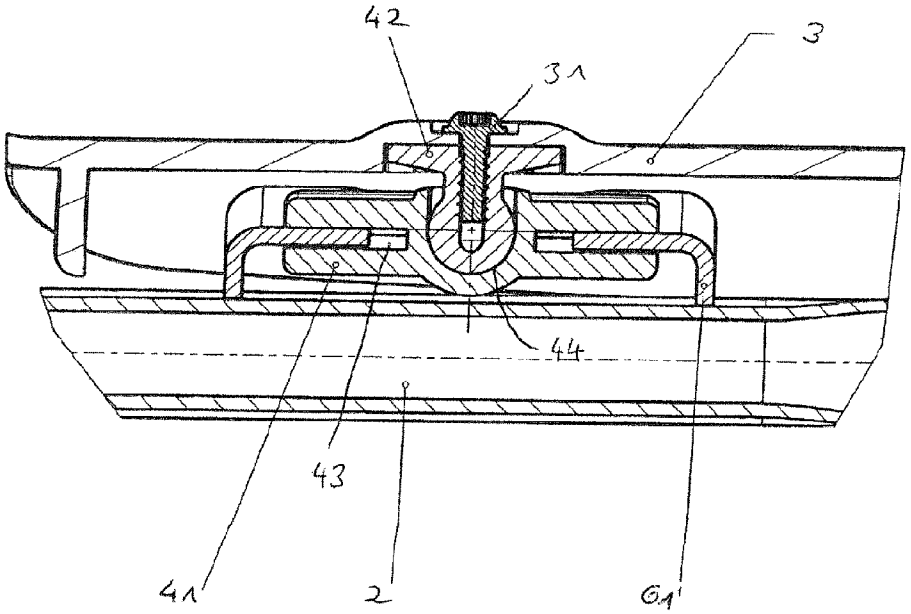
Figure 8:
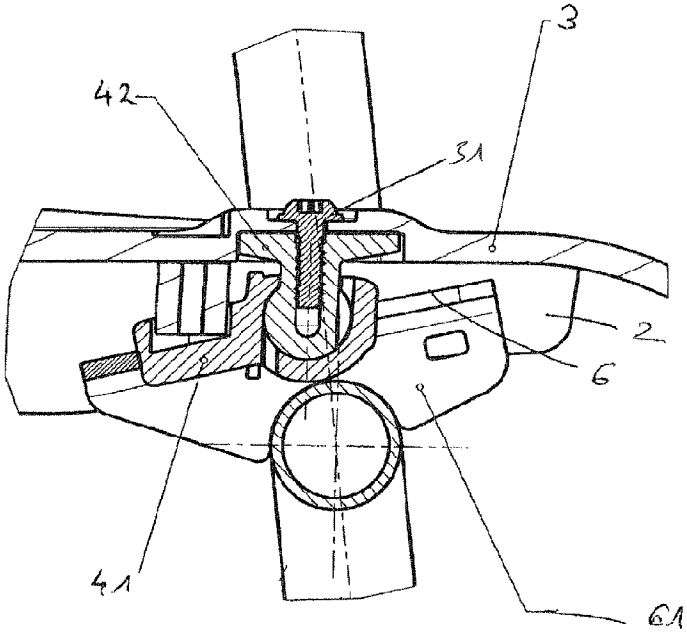

An exemplary embodiment of the invention is explained with reference to the enclosed drawings. They show:

FIG. 1 a schematic lateral view of a chair in the standard position,

FIG. 2 a schematic lateral view of a chair with maximally inclined backrest, FIG. 3 a schematic lateral view of a chair with unilaterally inclined backrest, FIGS. 4 to 6 corresponding illustrations of FIGS. 1 to 3 in top view, FIG. 7 a schematic representation for explaining the movement concept, FIG. 8 a schematic sectional representation of a sliding bearing in lateral view, and FIG. 9 a schematic sectional representation of a sliding bearing in front view.

It is noted with respect to the following description that the terms "at the top", "at the bottom", "at the front", "at the rear", "right", "left" respectively relate to the standard chair position.

According to FIGS. 1 to 6, the chair according to the invention comprises a base frame with four legs 1 mounted rigidly on a seat frame 2.

On the seat frame 2 is mounted a seat 3, namely on the front edge in a sliding bearing 4 and on its rear edge on the mounting end 5 of a side support. The mounting end 5 is designed to be angled, for example L-shaped, and is connected to the rear edge of the seat 3 via one arm. The other arm supports a backrest bar 7.

As can be seen in particular in FIGS. 4 to 6, the chair is designed symmetrically, i.e. the structure described above is provided on both sides of the chair. These figures also show that the backrest bars at their upper end [verb missing] by a rod 8, which is connected articulately to the backrest bars or has inherent elasticity.

FIG. 2 furthermore shows a supporting element 9, which respectively connects the backrest bar 7 to the base frame.

The movement concept of the chair according to the invention will now be explained with reference to FIG. 7, in which the same reference numbers were used for corresponding parts as in FIGS. 1 to 6, wherein the oblique guide surfaces 6 are illustrated on the base frame 2.

The side support comprises the backrest bar 7 and the mounting end 5, which are rigidly connected to each other and on their part are connected articulately to the supporting element 9 at a pivot point 12. This figure furthermore shows that the mounting end 5 is connected in a point of articulation 13 to the seat 3 in the region of its rear edge.

In case of an inclination of the side support backward, the side support is pivoted about the pivot point 12 and the mounting end 5 transfers this movement via the point of articulation 13 to the seat 3 and displaces the latter toward the front edge of the chair (left in FIG. 7), wherein the seat is guided along the oblique guide surface 6 in the sliding bearing 4. At the same time, the seat is raised in the region of its rear edge by the pivoting of the side support. By means of suitable dimensioning of the guide surfaces and the mounting end 5, the stroke of the seat in the region of its front edge or in the region of its rear edge can be adjusted.

FIG. 7 furthermore shows schematically a spring element 10, which is connected on the one hand at a point of articulation 15 to the base frame, on the other hand at a point of articulation 14 to the seat 3. This spring element pre-loads the seat in its upright position with the backrest standing vertically.

The different positions of the chair are best seen in FIGS. 1 to 6. FIGS. 1 and 4, for example, show the chair in its standard position, i.e. with the backrest upright.

FIGS. 2 and 5 show the chair with maximally reclined backrest. A comparison of FIGS. 1 and 2 shows that in this position, the seat is displaced to the front edge of the chair (leftward in the figures), wherein its front edge is slightly raised as a result of the oblique guide surfaces 6, its rear edge is raised slightly higher by the pivoting of the mounting end so that the seat as a whole slightly reduces its base inclination.

FIGS. 3 and 6 finally show the chair in its asymmetrical position, in which the right side support is inclined backward and its left side support assumes the substantially vertical position. In this case, the left edge of the chair remains at about the height of the position of FIG. 1, the right edge of the chair in about the position of FIG. 2, and the seat is rotated counter-clockwise when viewed in top view, which can be seen in FIG. 6.

On the one hand, these kinematics support a reclining within the meaning of a synchronous mechanism, on the other hand, a combined movement of the seat and the respective backrest support support a lateral reclining, whereby a comfortable and dynamic sitting is made possible.

For the sake of clarity, FIGS. 1 to 6 only show the upper side of the backrest with the backrest bars and the rod 11. Naturally, a suitable covering made of an elastic material can be provided.

FIGS. 8 and 9 show details of the sliding bearing in a lateral sectional view or a front sectional view, wherein one sliding bearing each is preferably used at the front on the right and left side.

As can be seen in these figures, a guide plate 61 per sliding bearing is mounted on the seat frame 2, which guide plate comprises a U-shaped cross section (FIG. 9) and has in the center an opening toward the front for a sliding piece 41. The guide plate 61 is mounted obliquely on the frame 2 (FIG. 8) and thus forms the oblique guide surfaces 6.

The edges of the openings of the guide plate 61 engage in the side grooves 43 of the sliding piece 41. The sliding piece furthermore comprises a ball bearing 44, which engages with a ball head 42. The ball head is mounted on the seat plate 3 by means of a screw 31.

According to the invention, the sliding piece 41 is mounted slidably on the guide plate 61 so that a displacement of the seat (to the right/left in FIG. 8) results in a lowering or raising of the seat, wherein a pivoting of the seat is possible at the same time as a result of the ball bearing and the ball head.

In FIG. 9, which shows the sliding bearing in a neutral position, can be seen that the edges of the guide plates 61 do not extend completely into the grooves 43 but leave a free space at the groove bottom. As a result of this free space, it is possible to displace or rotate the seat plate 3 in relation to the frame 2.

Since the chair according to the invention is preferably designed as a conference or visitor chair, the chair is shown as a four-legged chair in the exemplary embodiment above. It is however also possible to design the office chair as an office swivel chair or armchair known per se with a pivot mounting.

The invention claimed is:

1. An office chair comprising, a base frame (1, 2);

a seat (3); and a backrest, wherein the backrest includes two side supports that are articulated on the seat (3) and on the base frame (1, 2) swivably independently of each other, wherein the seat (3) is mounted displacably on the base frame such that a pivoting of the side supports brings about a displacement of the seat (3), wherein the seat (3) includes at least one sliding bearing (4), and wherein the at least one sliding bearing (4) comprises an oblique guide surface (6).

2. The chair according to claim 1, wherein each side support includes an angled mounting end (5), each angled mounting end having at least two arms, the seat having a rear end, wherein one arm of each angled mounting end is connected to the rear end of the seat (3) and the other arm forms a backrest bar (7).

3. The chair according to claim 1, wherein the seat (3) has a front edge, and wherein at least a region of the front edge is mounted in the at least one sliding bearing (4).

4. The chair according to claim 1, wherein the at least one sliding bearing is designed such that it allows a rotation in addition to a displacement of the seat.

5. The chair according to claim 4, wherein the at least one sliding bearing comprises a sliding piece (41) having a ball bearing (44) and a ball head (42).

6. The chair according to claim 5 having a spring element (10) mounted between the seat (3) and the base frame.

7. The chair according to claim 6, wherein the spring element is loaded during a displacement of the seat.

8. The chair according to claim 7 having a rod that connects the backrest bars to each other, wherein the rod is articulated on the backrest bars and has inherent elasticity.

* * * * *